US008881556B2

(12) United States Patent
Kawabata et al.

(10) Patent No.: US 8,881,556 B2
(45) Date of Patent: Nov. 11, 2014

(54) WASHING AND DRYING MACHINE

(75) Inventors: Shinichiro Kawabata, Tokyo (JP); Satoru Nishiwaki, Tokyo (JP); Hisao Tatsumi, Tokyo (JP)

(73) Assignees: Kabushiki Kaisha Toshiba, Tokyo (JP); Toshiba Ha Products Co., Ltd., Osaka (JP); Toshiba Consumer Marketing Corporation, Tokyo (JP)

( * ) Notice: Subject to any disclaimer, the term of this patent is extended or adjusted under 35 U.S.C. 154(b) by 689 days.

(21) Appl. No.: 12/094,065

(22) PCT Filed: Aug. 28, 2006

(86) PCT No.: PCT/JP2006/316870

§ 371 (c)(1),
(2), (4) Date: May 16, 2008

(87) PCT Pub. No.: WO2007/058009

PCT Pub. Date: May 24, 2007

(65) Prior Publication Data

US 2009/0178442 A1 Jul. 16, 2009

(30) Foreign Application Priority Data

Nov. 18, 2005 (JP) ..... 2005-334367

(51) Int. Cl.

| | |
|---|---|
| ***D06F 37/00*** | (2006.01) |
| ***D06F 58/20*** | (2006.01) |
| ***D06F 39/08*** | (2006.01) |
| *D06F 58/28* | (2006.01) |

(52) U.S. Cl.

CPC ..... *D06F 58/28* (2013.01); *D06F 58/206* (2013.01); *D06F 2058/2858* (2013.01); *D06F 39/083* (2013.01)

USPC ..... 68/208; 68/19.2

(58) Field of Classification Search

USPC ..... 68/208

See application file for complete search history.

(56) References Cited

U.S. PATENT DOCUMENTS

| | | | |
|---|---|---|---|
| 2,627,669 | A | 2/1953 | Candor |
| 3,691,649 | A | 9/1972 | Pigors |

(Continued)

FOREIGN PATENT DOCUMENTS

| | | | |
|---|---|---|---|
| CN | 1231357 | | 10/1999 |
| CN | 1497091 | A | 5/2004 |

(Continued)

OTHER PUBLICATIONS

JP 11-114273—translation provided by applicant on Jun. 16, 2010.*

(Continued)

*Primary Examiner* — David Cormier
(74) *Attorney, Agent, or Firm* — DLA Piper LLP (US)

(57) ABSTRACT

A washing and dehydrating machine includes a circulating passage communicating between interior and exterior of a water tub, warm air generating unit rendering air in the passage warm, an overflow outlet located in the water tub surface, so that water flows through the overflow outlet when a water level in the water tub is increased to or above a level, a drain conduit introduced outside the machine via a drain valve, through which water in the water tub is discharged, an overflow conduit having a lower end connected to the drain valve and communicating with the overflow outlet, and air stopping unit located in the overflow conduit and including a trap cutting off air flow and a water supply unit supplying water to the trap, allowing water to pass through and stopping air flow. The overflow conduit is introduced outside the machine via the air stopping unit.

6 Claims, 7 Drawing Sheets

(56) References Cited

U.S. PATENT DOCUMENTS

| | | | | |
|---|---|---|---|---|
| 3,805,404 | A | 4/1974 | Gould | |
| 4,891,892 | A | 1/1990 | Narang | |
| 5,042,171 | A | 8/1991 | Obata | |
| 5,884,506 | A * | 3/1999 | Blauert et al. | 68/17 R |
| 6,282,928 | B1 * | 9/2001 | Fukumoto et al. | 68/20 |
| 6,378,341 | B1 * | 4/2002 | Wiemer et al. | 68/12.02 |
| 6,748,772 | B2 | 6/2004 | Lee | |
| 6,966,124 | B2 | 11/2005 | Ryu | |
| 7,024,795 | B2 | 4/2006 | Tadano | |
| 7,296,443 | B2 * | 11/2007 | Usherovich et al. | 68/3 R |
| 7,520,145 | B2 | 4/2009 | Hong | |
| 7,814,770 | B2 | 10/2010 | Jeon | |
| 7,866,061 | B2 | 1/2011 | Tatsumi | |
| 2003/0056393 | A1 | 3/2003 | Lee | |
| 2004/0079121 | A1 | 4/2004 | Yabuuchi et al. | |
| 2005/0246920 | A1 | 11/2005 | Yabuuchi et al. | |
| 2010/0024239 | A1 | 2/2010 | Kono | |
| 2010/0107703 | A1 | 5/2010 | Hisano | |

FOREIGN PATENT DOCUMENTS

| | | | |
|---|---|---|---|
| DE | 10255575 | | 12/2003 |
| DE | 69922864 | | 6/2005 |
| EP | 0911438 | | 4/1999 |
| EP | 0942093 | A1 | 9/1999 |
| EP | 1197592 | | 4/2002 |
| EP | 1411163 | A2 | 4/2004 |
| JP | 47-8921 | | 4/1972 |
| JP | 48-12593 | B1 | 4/1973 |
| JP | S63-183095 | | 7/1988 |
| JP | H02-148697 | | 12/1990 |
| JP | H06-335599 | | 12/1994 |
| JP | 10-071292 | | 3/1998 |
| JP | A-H11-114273 | | 4/1999 |
| JP | A-2000-225286 | | 8/2000 |
| JP | 2004-135715 | | 5/2004 |
| JP | 2004-135755 | | 5/2004 |
| JP | 2004-337519 | | 12/2004 |
| JP | 2005-27734 | A | 2/2005 |
| JP | 2005-27768 | | 2/2005 |
| JP | 2005-034163 | | 2/2005 |
| JP | A-2005-46414 | | 2/2005 |
| JP | 2005-052533 | | 3/2005 |
| JP | 2005-052534 | | 3/2005 |
| JP | 2005-137646 | | 6/2005 |
| JP | 2005-224414 | A | 8/2005 |
| JP | 2005-318917 | A | 11/2005 |
| JP | 2006-015118 | | 1/2006 |
| JP | 2006-122466 | | 5/2006 |
| JP | 2006-314839 | | 11/2006 |
| JP | 2006-314840 | | 11/2006 |
| KR | 2004-0100894 | | 12/2004 |
| WO | WO 03/57968 | | 7/2003 |

OTHER PUBLICATIONS

Office Action issued in CN Appl 200680042899.7 on Nov. 20, 2009.
English Translation of Office Action issued in CN Appl 200680042899.7 on Nov. 20, 2009.
English Abstract of CN 1231357 published Oct. 13, 1999.
English abtract of JP A-2000-225286.
English abtract of JP-A-H11-114273.
English abtract of JP-A-2005-4614.
Search Report from PCT/JP2006/316870.
Search Report from PCT/JP2006/313486 dated Aug. 8, 2006.
Search Report from PCT/JP2006/320643 dated Dec. 5, 2006.
English abstract of JP-2005-224414A published Aug. 25, 2005.
English abstract of JP-2005-27734 published Feb. 3, 2005.
Chinese Office Action issued in corresponding Application No. 200680005481.9 mailed Mar. 6, 2009.
English translation of Chinese Office Action issued in corresponding Application No. 200680005481.9 mailed Mar. 6, 2009.
English Abstract of JP 2005-052533 published Mar. 3, 2005.
Notice of Submission of Argument issued on Mar. 16, 2009 in corresponding Korean patent application No. 7020455/2007.
English translation of Notice of Submission of Argument issued on Mar. 16, 2009 in corresponding Korean patent application No. 7020455/2007.
English Abstract of KR 2004-0100894 published Dec. 2, 2004.
Machine English language translation of JP 2005-034163 dated Feb. 10, 2005.
English Abstract of JP 2005-034163 dated Feb. 10, 2005.
English Language Abstract of JP 2005-27768 published Feb. 3, 2005.
English Language Abstract, of JP 2004-135755 published May 13, 2005.
English Language Abstract of JP H06-335599 published Dec. 6, 1994.
English Language Abstract of JP 2004-337519 published Dec. 2, 2004.
English Language Abstract of JP 2004-135715 published May 13, 2004.
Machine Language Translation of JP 2005-27768 published Feb. 3, 2005.
Machine Language Translation of JP 2004-135755 published May 13, 2005.
Machine Language Translation of JP H06-335599 published Dec. 6, 1994.
Machine Language Translation of JP 2004-337519 published Dec. 2, 2004.
Machine Language Translation of JP 2004-135715 published May 13, 2004.
United Kingdom Office Action issued in GB0716373.6 on Jul. 13, 2009.
Office Action issued in Chinese Application 200680027088 on Aug. 14, 2009.
English Abstract of JP 2005-052534 published Mar. 3, 2004.
English machine translation of JP 2005-052534 published Mar. 3, 2004.
English machine translation of JP 2005-052533 published Mar. 3, 2005.
Office Action issued in Japanese Appl 2005-045612 on Feb. 9, 2010.
English Abstract of Japanese Publication No. H02-148697 on Dec. 18, 1990.
English Translation of Office Action issued in Japanese Appl 2005-045612 on Feb. 9, 2010.
File History of U.S. Appl. No. 11/816,568.
File History of U.S. Appl. No. 12/094,937.
File History of U.S. Appl. No. 11/996,677.
English Abstract of JP 2005-318917A published Nov. 17, 2008.
Machine English Translation of JP 2005-318917A published Nov. 17, 2008.
Machine English Translation of JP 2000-225286 published Aug. 15, 2000.
Machine English Translation of JP 2005-224414 published Aug. 25, 2005.
Machine English Translation of JP H11-114273 published Apr. 27, 1999.
Machine English Translation of JP 2005-46414 published Feb. 24, 2005.
Machine English Translation of JP 2005-27734 published Feb. 3, 2005.
English Language Translation of Chinese Office Action issued on Aug. 14, 2009 in CN Appl. 200680027088.X.
English Language Abstract of CN 1497091 published May 19, 2004.
Japanese Office Action issued in JP 2005-215959 on Mar. 8, 2011.
English Translation of Japanese Office Action issued in JP 2005-215959 on Mar. 8, 2011.
Concise Explanation of relevance of JP47-8921 published Apr. 5, 1972.
English Language Abstract of DE 10255575 published Dec. 11, 2003.
German Office Action issued in DE 11 2006001946.5-26 on Apr. 1, 2011.
English Translation of German Office Action issued in DE 11 2006001946.5-26 on Apr. 1, 2011.
U.S. Appl. No. 11/816,568 as of Jun. 17, 2010 to May 23, 2011.

(56) References Cited

OTHER PUBLICATIONS

U.S. Appl. No. 11/996,677 as of Jun. 17, 2010 to May 23, 2011.
U.S. Appl. No. 12/094,937 as of Jun. 17, 2010 to May 23, 2011.
Office Action issued in JP Appl 2005-334367 on Mar. 8, 2011.
English Translation of Office Action issued in JP Appl 2005-334367 on Mar. 8, 2011.
English abstract of JP-A-2005-46414 published Feb. 24, 2005.
U.S. Appl. No. 11/816,568.
English Language Abstract of JP 10-071292 published Mar. 17, 1998.
English Language Translation of JP 10-071292 published Mar. 17, 1998.
English Language Abstract of JP 2005-137646 published on Jun. 2, 2005.
English Language Translation of JP 2005-137646 published on Jun. 2, 2005.
English Language Abstract of JP 2006-015118 published on Jan. 19, 2006.
English Language Translation of JP 2006-015118 published on Jan. 19, 2006.
English Language Abstract of JP 2006-122466 published on May 18, 2006.
English Language Translation of JP 2006-122466 published on May 18, 2006.
English Language Abstract of JP 2006-314839 published on Nov. 24, 2006.
English Language Translation of JP 2006-314839 published on Nov. 24, 2006.
English Language Abstract of JP 2006-314840 published on Nov. 24, 2006.
English Language Translation of JP 2006-314840 published on Nov. 24, 2006.
U.S. Appl. No. 12/094,937 as of Oct. 14, 2011.
English Language Abstract of DE 69922864 published Jun. 9, 2005.
Chinese Office Action issued in CN 200680042899.7 on Dec. 5, 2012.
English Language Translation of Chinese Office Action issued in CN 200680042899.7 on Dec. 5, 2012.
Office Action issued in on CN Appl 200680042899.7 on May 21, 2012.
English Translation of Office Action issued in CN Appl 200680042899.7 on May, 21 2012.
Supplementary European Search Report issued in EP 06783090.2 on May 20, 2011.
U.S. Appl. No. 11/996,677.
Chinese Office Action issued in CN 200680042899.7 on Apr. 16, 2014 with English Language Translation.
Communication from Board of Appeals issued in Chinese Application No. 200680027088 dated May 5, 2014 with English Language Translation.

* cited by examiner

RELATED ART

WASHING AND DRYING MACHINE

TECHNICAL FIELD

The present invention relates to a washing and drying machine provided with a function of drying laundry by supplying warm air by circulation.

BACKGROUND ART

This type of washing and drying machine includes a washing and drying machine comprising a drum rotated about a horizontal axis and a washing and drying machine comprising an inner tub rotated about a vertical axis. Each of the drum and the inner tub has a circumferential wall formed with a number of small holes and functions as a rotating tub. These washing and drying machines have a similar washing function and a similar drying function. For example, in a drying step, drying warm air is supplied by circulation while the rotating tub is rotated at low speeds, so that laundry accommodated in the rotating tub is dried. A water tub (outer tub) capable of storing water is provided outside the rotating tub. The washing and drying machine carries out washing with the water tub storing water.

When a water-supplying operation is continued even after supplied water exceeds a predetermined water level owing to failure in water supply or a control device of a water-supply valve, for example, water overflows such that there is a possibility that electrical components may be drenched and the floor may become sloppy. In view of the problem, the water tub is formed with overflow outlets through which overflowed water is directly discharged out of the machine when the water level in the water tub exceeds a predetermined level. On the other hand, the aforesaid drying warm air is adapted to be circulated through the water tub. Accordingly, the overflow outlets are located so that overflowed water is discharged through the overflow outlets before entering an outlet and an inlet of warm air, as in a washing and drying machine described in Japan published patent application No. 2005-46414 (JP-A-2005-46414).

FIG. 7 illustrates an example of conventional drum washing and drying machine of this type. This washing and drying machine includes a casing 1 in which a water tub 2 is elastically suspended. A drum 3 is provided in the water tub 2 so as to be rotatable about a transverse axis in a slightly inclined state. The casing 1 has a front formed with an access opening 1*a* through which laundry is put into and taken out of the drum 3. The access opening 1*a* is watertightly connected via elastic bellows 4 to an opening end provided in the front of the water tub 2. The access opening 1*a* is adapted to be opened and closed by a pivotally mounted door 5. An electric motor 6 is mounted on a rear of the water tub 2 and has a rotational shaft which is directly connected to a rear of the drum 3. Accordingly, rotative power of the motor 6 is directly transmitted to the drum 3. Furthermore, a drain conduit 7 with a midway drain valve 8 is provided on the bottom of the water tub 2. The drain conduit 7 is introduced outside the casing 1 (the washing and drying machine) so that water in the water tub 2 is drained through the drain valve 8 to a predetermined drainage location.

An air supply duct 9 has an upper end connected to the upper rear of the water tub 2. An exhaust duct 10 has an upper end connected to the front of the water tub 2. The air supply duct 9 and the exhaust duct 10 have respective lower ends which are connected to each other by a heat exchange duct 11 provided with a warm air generating unit so as to communicate with each other. The warm air generating unit comprises a known heat pump mechanism 40.

The heat pump mechanism 40 is adapted to pump refrigerant by a compressor 13 and to circulate the refrigerant through a condenser 14, a capillary tube (serving as a refrigerant throttle valve) and an evaporator 15 sequentially. The condenser 14 heat-exchanges air circulated in the heat exchange duct 11, thereby heating the air. A blower 16 supplies the air heated by the condenser 14 through the air supply duct 9 into the water tub 2 and the drum 3 as warm air. As a result, laundry in the drum 3 is dried. Air used for drying and containing water content is cooled by the evaporator 15 thereby to be dehumidified. The air is then heated by the condenser 14 and re-supplied as drying warm air into the drum 3. That is, drying air is supplied into the drum 3 to dry laundry while being circulated in the circulation air passage 12 as shown by arrow A in FIG. 7.

An overflow outlet 17 is provided at a predetermined position in a rear wall of the water tub 2 in order to cope with abnormal overflow water such as described above. The predetermined position is set so as to be located lower than a connecting hole of the air supply duct 9 serving an outlet of the circulation air passage 12 and a connecting hole of the exhaust duct 10 serving as an inlet of the circulation air passage 12. The overflow outlet 17 is constructed so that overflowed water caused to flow therethrough is directly discharged outside the machine through a drain passage such as an overflow conduit 18 and a drain conduit 7. A water supply conduit 20 is provided on an upper part of the water tub 2 so as to communicate with the water tub 2. The water supply conduit 20 includes a water supply valve 19 connected to a water supply. The water supply conduit 20 is capable of supplying water into the water tub 2 and the drum 3.

According to the foregoing construction, water in the water tub 2 is discharged outside the machine through the overflow outlet 17 before entering the circulation air passage 12 even when water supply to the water tub 2 is in an abnormal condition. Accordingly, a water level in the water tub 2 is prevented from being increased to or above a predetermined level. On the other hand, in the drying step, warm air is generated the heat pump mechanism 40 disposed in the heat exchange duct 11. The warm air is supplied through the air supply duct 9 from the rear side of the water tub 2 into the drum 3. In this case, the pressure in the water tub 2 is increased by the circulated warm air. When the heat pump mechanism 40 is employed as a warm air generating unit, a temperature of the warm air tends to be lower than in the case where an electric heater is employed. Accordingly, a cooling performance of the compressor 13 needs to be increased to about 1500 W, for example, and a flow rate of circulated air also needs to be increased to about 3 m.sup.3/min, for example. As a result, the inner pressure of the water tub 2 tends to be further increased.

In the drying step, an efficient drying operation is desired by making use of a closed space including the circulation air passage 12 with the circulation air flowing through the water tub 2. However, since the aforesaid overflow outlet 17 normally communicates with the exterior of the machine through the drain passage such as the overflow conduit 18, part of warm air leaks through the overflow outlet 17 out of the machine during the drying step, resulting in loss of heat energy. The heat energy loss becomes more significant as the inner pressure of the water tub 2 is increased as described above.

Furthermore, as shown in FIG. 7, the front side of the water tub 2 has a positional limitation due to the access opening 1*a* or the like. Accordingly, the overflow outlet 17 is normally formed at the rear side of the water tub 2. However, since supply of warm air is also carried out on the rear of the water tub 2, part of the warm air supplied through the air supply duct 9 tends to flow to the overflow outlet 17 side before supplied into the drum 3 (as shown by broken arrow B in FIG. 7), whereupon the warm air leaks out of the machine. Thus, leak of part of warm air prevents improvement in the drying efficiency. Furthermore, when part of warm air is discharged into a room where the washing and drying machine is installed, the temperature and humidity in a residential space are increased. Laundry contains a large amount of water particularly in a first half of the drying step. As a result, the humidity of the warm air discharged out of the machine is increased, resulting in discomfort of the user.

An object of the present invention is to provide a washing and drying machine which can carry out an efficient drying operation without damaging the original function of the overflow outlet by preventing warm air from leaking during the drying step.

Means for Overcoming the Problem

The present invention provides a washing and dehydrating machine comprising a rotating tub having small holes in a circumferential wall and receiving laundry, a water tub which is provided around the rotating tub and is capable of storing water, a circulating passage communicating between an interior and an exterior of the water tub so that air is circulated therethrough, a warm air generating unit rendering air in the circulating passage warm, an overflow outlet which is provided in a surface of the water tub where warm air is supplied, so that water flows through the overflow outlet when a water level in the water tub is increased to or above a predetermined level, a drain conduit provided at a bottom of the water tub and extending outside the machine via a drain valve provided midway in the drain conduit, through which water in the water tub is discharged out of the water tub, an overflow conduit having a lower end connected to a downstream side of the drain valve in the drain conduit and communicating with the overflow outlet and with the outside of the machine, and a trap provided in the overflow conduit and cutting off an air flow by storing water therein, thereby allowing water to pass therethrough and stopping an air flow, wherein the overflow conduit is introduced outside the machine via the trap; and a water supply unit coupled to the trap to introduce water to the trap other than from the drain conduit.

Effect of the Invention

According to the washing and drying machine of the invention, water is promptly discharged through the overflow outlet when the water level in the water tub is at or above the predetermined level. Accordingly, an abnormal overflow condition can be avoided without damaging the original function of the overflow outlet. Furthermore, ventilation of the overflow outlet is cut off by the air stopping unit in the drying step, whereupon hot air or the like can be prevented from leaking out of the machine. Consequently, an efficient drying operation can be carried out.

DETAILED DESCRIPTION

First Embodiment

Figure 1:
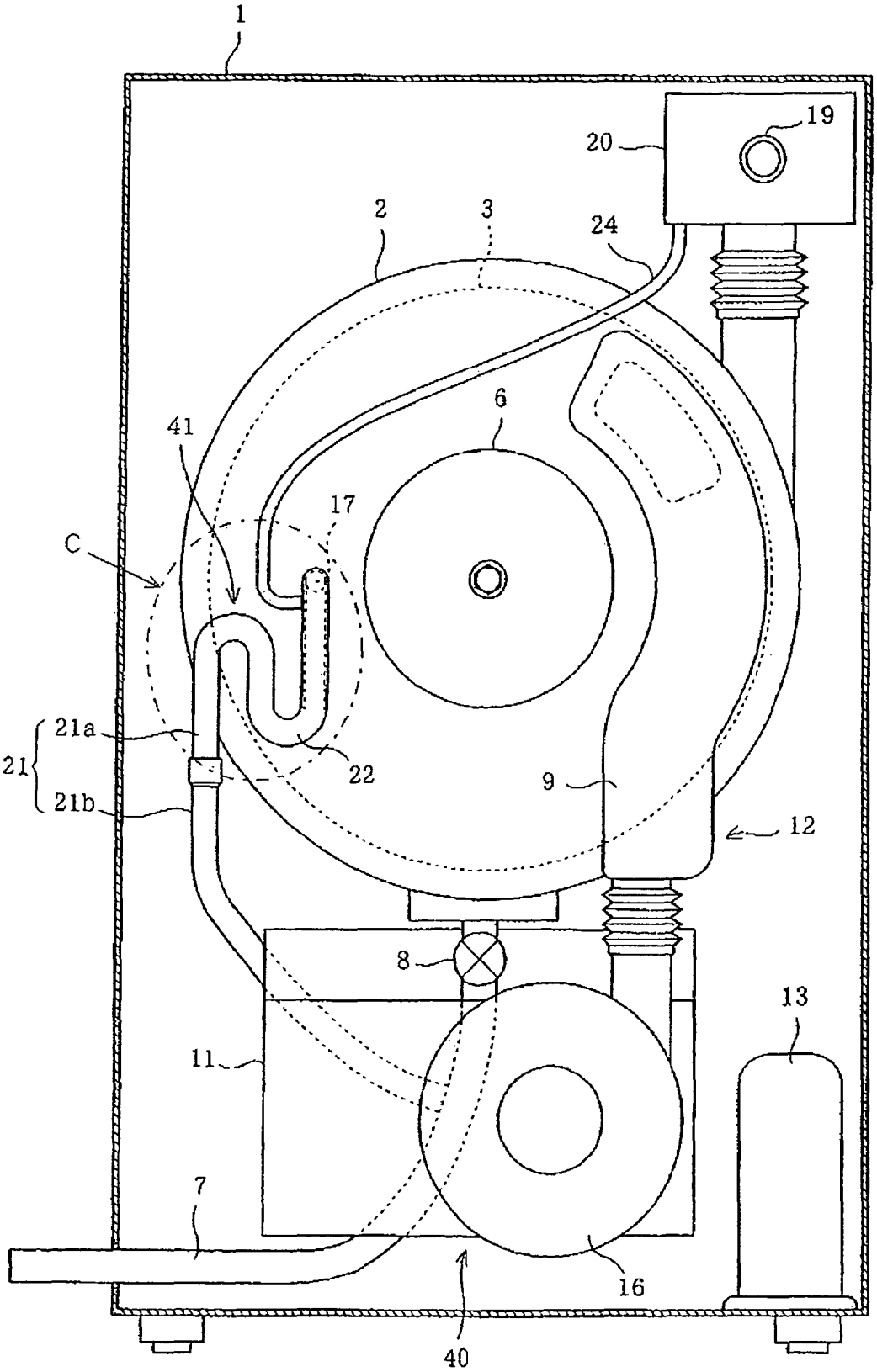
FIG. 1 is a rear view of drum washing and drying machine of a first embodiment of the present invention with a rear plate being removed.
Figure 2:
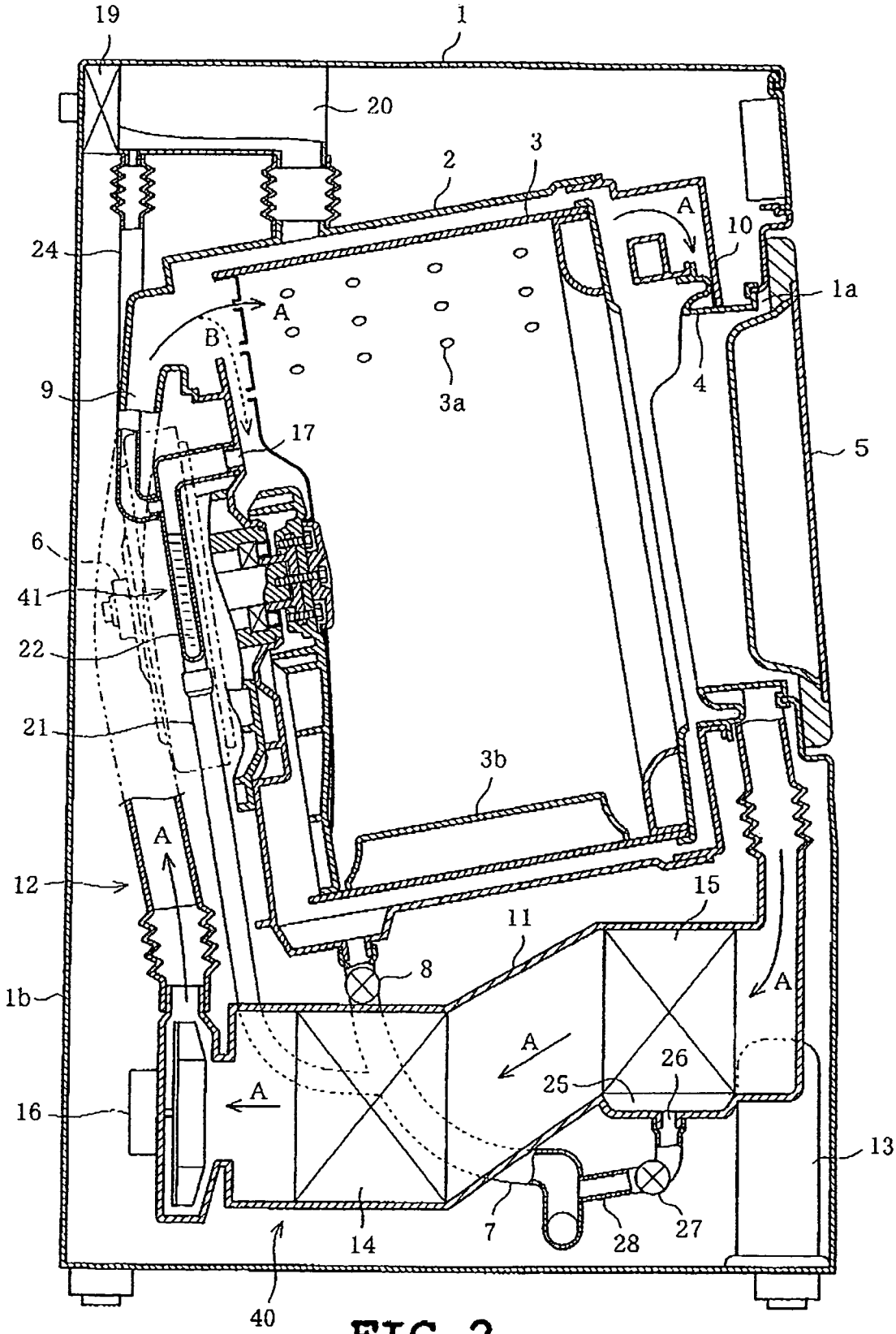
FIG. 2 is a longitudinal side section of the whole washing and drying machine.
Figure 3:
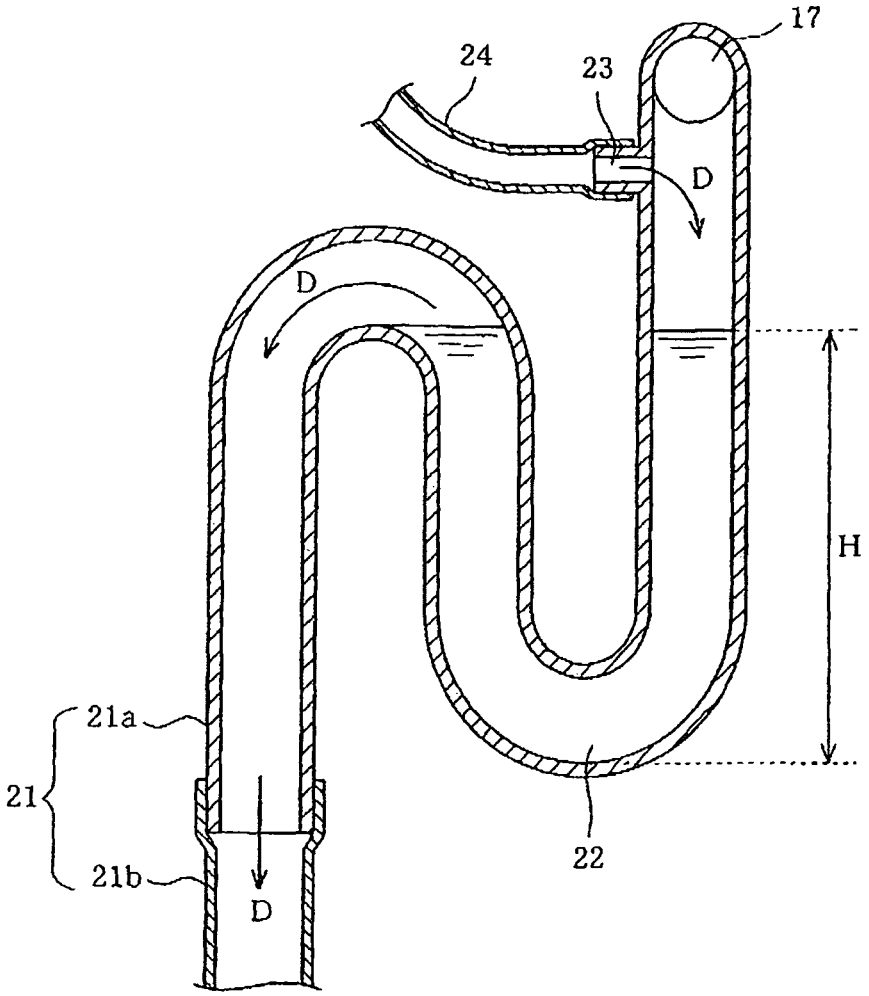
FIG. 3 is an enlarged longitudinal rear section of a part designated by reference C in FIG. 1.
Figure 7:
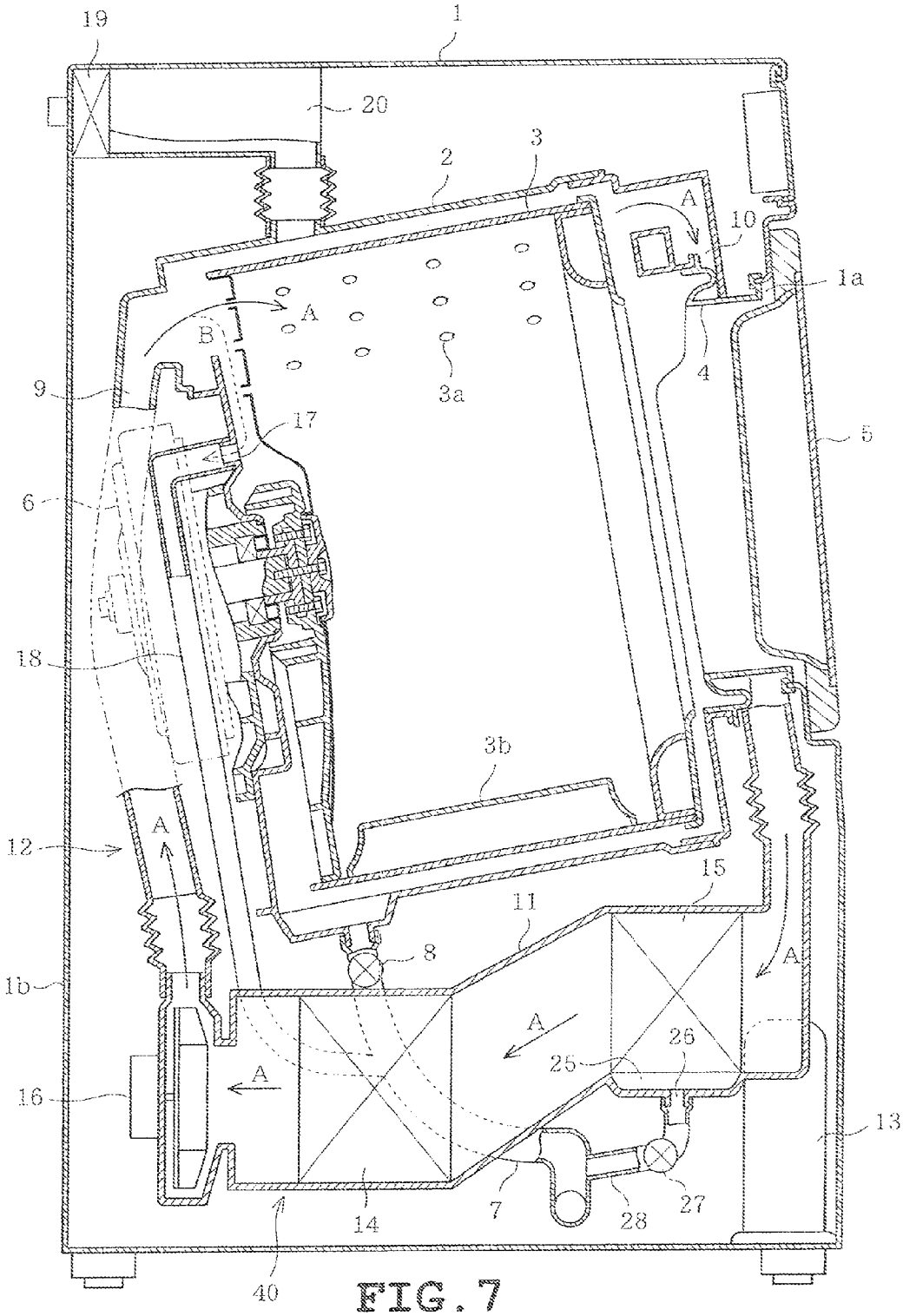
FIG. 7 is a view similar to FIG. 2, showing a conventional example.

A first embodiment of the present invention will be described with reference to FIGS. 1 to 3. FIG. 1 is a rear view of drum washing and drying machine of a first embodiment of the present invention with a rear plate being removed. FIG. 2 is a longitudinal side section of the whole washing and drying machine. FIG. 3 is an enlarged longitudinal rear section of a part designated by reference C in FIG. 1. Of the construction of the washing and drying machine, parts common to the conventional construction shown in FIG. 7 are labeled by the same reference symbols as those in the conventional construction, and the description of the common parts of the construction will be simplified or eliminated.

Referring to FIGS. 1 and 2, a casing 1 constituting an outer envelope of the washing and drying machine encloses therein a water tub 2 which is elastically suspended by suspensions (not shown) and is capable of storing water. In the water tub 2 is provided a drum 3 which has a circumferential wall formed with a number of small holes 3*a* and a baffle 3*b* and functions as a rotating tub. Front openings of the water tub 2 and the drum 3 are opposed to an access opening 1*a* of the front of the casing 1. The water tub 2 has a rear formed with an overflow outlet 17 located lower than an upper end side of an air inlet duct 9 (an outlet of an air circulating passage 12 which will be described later) and an upper end side of an exhaust air duct 10 (an inlet of the air circulating passage 12). In the embodiment, the following devisal is applied to a drain channel extending from the overflow outlet 17 outside the casing 1.

An overflow conduit 21 communicating with the overflow outlet 17 comprises a joint member 21*a* and a hose pipe 21*b* as shown in FIG. 3. The joint member 21*a* is provided with a trap 22 which meanders in a U-shape and is formed so as to store water therein. The joint member 21*a* has an upper end connected to the overflow outlet 17. A water supply inlet 23 is formed integrally in an upper part of the trap 22. An upper part of the trap 22 is located higher than a storable water level H (store water level H) and lower than the overflow outlet 17 (between the water level H and the overflow outlet 17). To the water supply inlet 23 is connected a small pipe-like trap water supply conduit 24 bifurcating from a water supply conduit 20. The trap water supply conduit 24 serves as a water supply unit for the trap 22. Furthermore, water supply to the trap 22 is controlled by a water supply valve 19. The overflow conduit 21 has a lower end connected to a downstream part of a drain valve 8 in a drain conduit 1, whereby the lower end of the overflow conduit 21 normally communicates with an outside of the machine.

The air inlet duct 9 and the exhaust air duct 10 are fixed to the water tub 2 side and both constitute the air circulating passage 12 through the water tub 2. On the other hand, a heat exchange duct 11 disposed below the water tub 2 is fixed to and supported by the casing 1 side. Connecting portions between the air inlet duct 9 and the exhaust air duct 10 and the heat exchange duct 11 are formed into a bellow-shape and elastically telescopic.

A heat pump mechanism 40 serving as a warm air generating unit is disposed on a part of the air circulating passage 12 constituted by the heat exchange duct 11. In the embodiment, the heat exchange duct 11 is formed so as to have steps in an up-and-down direction. An evaporator 15 is disposed at a higher side of the heat exchange duct 11 (front side). The evaporator 15 has a function of dehumidifying air (a dehumidifying function). A condenser 14 is disposed at a lower side (rear side) and has a function of heating air (a heating function). The underside of the heat exchange duct 11 includes a part corresponding to the evaporator 15. A water collecting recess 25 and a drain outlet 26 are formed in the part of the underside of the heat exchange duct 11. A dehumidification water drain conduit 28 provided with an on-off valve 27 is provided below the water collecting recess 25 and the drain outlet 26. The dehumidification water drain conduit 28 connects between the drain outlet 26 and the drain conduit 7 so that dehumidification water collected to the water collecting recess 25 is discharged to a predetermined drain location outside the machine.

The operation of the drum washing and drying machine will now be described. In this type of washing and drying machine, a rotational speed of the drum 3 is controlled so that steps of wash, dehydration and drying are automatically executed, as well known. In the wash step (including a rinse step), the water supply valve 19 is opened to supply water through the water supply conduit 20 into the water tub 2. In this case, the washing and drying machine is controlled so that an amount of water according to a volume of laundry is supplied and a predetermined water level is reached in the water tub 2. At the same time, water is supplied through the trap water supply conduit 24 branching off from the water supply conduit 20 and the water supply inlet 23 into the joint member 21*a*.

Accordingly, water supply to the joint member 21*a* of the overflow conduit 21 is continued while water is supplied into the water tub 2. Thus, water in the joint member 21*a* does not remain in the U-shaped trap as shown in FIG, 3 but keeps flowing over an upper end of the trap 22, further flowing through the drain passage such as the overflow conduit 21 and the drain conduit 7 outside the machine. When the predetermined water level is reached in the water tub 2, the water supply valve 19 is closed such that the water supply operation through the water supply conduit 20 is stopped and the water supply to the overflow conduit 21 is also stopped. As a result, water remains in the U-shaped portion of the trap 22 such that the water level H is ensured as shown in FIG. 3.

The water level H remains unchanged when a water supply operation is not carried out thereafter. Even when a water supply operation is carried out thereafter, the remaining water is replaced by newly supplied water but the water level H remains unchanged in the trap 22. Furthermore, even if an abnormal condition occurs in the water supply such that the water supply to the water tub 2 is continued thereby to increase the water level in the water tub 2, water over the predetermined water level is discharged from the overflow outlet 17. Accordingly, an occurrence of abnormal overflow due to an increase in the water level can be avoided.

Since the trap water supply conduit 24 is formed into a pipe whose diameter is rendered as small as possible, an amount of water supplied through the conduit 24 is reduced into a small amount. Accordingly, an amount of water flowing through the overflow conduit 21 and the drain conduit 7 outside the machine is rendered as small as possible.

In the drying step (the drying operation), the drum 3 is rotated at low speeds. Furthermore, drying warm air is caused to flow through the circulation air passage 12 in the direction of arrow A in FIG. 2 by the blower 16, being circulated through the water tub 2 into the drum 3. The drying warm air is generated by heat exchange between air in the circulation air passage 12 and a refrigerant compressed and rendered high-temperature and heated in the condenser 14 of the heat pump mechanism 40. The generated warm air is supplied through the air supply duct 9 from the rear side of the water tub 2 and further through a plurality of small holes 3*a* of the drum 3 into the drum. The warm air having absorbed water content in the laundry in the drum 3 thereby having contributed to the drying is transferred through the front side exhaust duct 10 into the heat exchange duct 11 in a water-containing state.

Heat exchange is executed between air transferred to the heat exchange duct 11 and the refrigerant expanded by a capillary tube (not shown), whereupon the air is cooled. As a result, the water content in the air is condensed thereby to be dehumidified. The dehumidified water drops thereby to be collected into the water collecting recess 25. The dehumidified water collected in the recess 25 is discharged from the drain outlet 26 through the opened on-off valve 27 and the dehumidification water drain conduit 28 and further through the drain pipe passage 7 joined to the conduit 28 to the drain location outside the machine.

On the other hand, the air dehumidified in the evaporator 15 flows in the heat exchange duct 11. Heat exchange is again carried out between the dehumidified air and the refrigerant in the condenser 14 at the low position side and then heated, thereafter being supplied into the drum 3 as the drying warm air. Thus, the drying of laundry progresses by circulating air while the air is heated and dehumidified repeatedly. It is desirable that the circulation of warm air as described above should be carried out in a closed space in the whole circulation air passage 12 including the water tub 2. In the embodiment, air permeability of the overflow outlet 17 communicating with the exterior of the machine is cut off when water is stored in the trap 22 provided in the overflow conduit 21 (the joint member 21*a*). More specifically, the trap 22 functions as air stopping unit 44 together with the trap water supply conduit 24. Accordingly, even if part of warm air flows along the rear side of the drum 3 (as shown by the broken line arrow B in FIG. 2), the warm air can contribute to the drying of laundry without leaking through the overflow outlet 17 outside the machine. The water stored in the trap is replaced by new water every time a water supply operation is carried out in the wash step.

The following effects can be achieved from the first embodiment. When a water supply operation is carried out in the wash step prior to the drying step, water is stored in the trap 22 constituting the overflow conduit 21. Accordingly, the flow paths communicating with the drain passage to the exterior of the machine are maintained in an air-permeability cut-off state. Furthermore, a simple construction can be achieved since water is supplied to the trap 22 using the water supply unit for the wash operation, Furthermore, overflowed water is discharged through the overflow outlet 17 upon occurrence of an abnormal water supply. The overflow outlet 17 is located higher than the U-shaped trap 22. Consequently, the water level in the water tub 2 can be prevented from being increased to or above the predetermined level, Thus, although the overflow outlet 17 has an original function of coping with an abnormal overflow, the original function of the overflow outlet 17 can be prevented from being damaged.

The drying step is initiated and completed while water is stored in the trap 22, that is, while an air flow is blocked by the air stopping unit 41. As a result, warm air can smoothly be circulated throughout the drying step without leaking through the overflow outlet 17. Furthermore, since warm air is not discharged into the room (outside the washing and drying machine) an inhabited environment can be prevented from being adversely affected by increases in the temperature and humidity. Furthermore, warm air does not give any unpleasantness to the user. Accordingly, no problem arises when the washing and drying machine is installed indoors.

Since the heat pump mechanism 40 is used as the warm air generation unit, thermal energy can effectively be utilized. Furthermore, warm air can reliably be prevented from leaking through the overflow outlet 17 even when the pressure in the water tub 2 is increased by increasing the cooling performance of the compressor 13 or a flow rate of circulated air for the purpose of improving the drying performance. Consequently, the performance of the warm air generation unit and the freedom in the design can be improved. In particular, when warm air is taken from the rear side of the water tub 2 and the overflow outlet 17 needs to be provided in the rear side, part of fresh warm air which has not been supplied to the drum 3 before contributing to drying leaks through the overflow outlet 17 in the conventional construction (as shown by broken line arrow B in FIG. 7). According to the foregoing embodiment, leakage of hot air through the overflow outlet 17 can reliably be prevented in the foregoing embodiment.

Water storage (water supply) in the trap 22 is carried out by a water supply unit commonly using the water supply valve 19 for supply of washing water. However, the water supply should not be limited to the water supply unit. For example, a water supply valve dedicated to the trap 22 may be provided so that a water supply operation is carried out in response to execution of a drying step. In this case, when the water supply valve dedicated to the trap 22 is controlled independent of the water supply valve 19, a necessary amount of water can be supplied to the trap 22, whereupon useless water can be prevented from flowing as compared with the foregoing embodiment.

Second Embodiment

Figure 4:
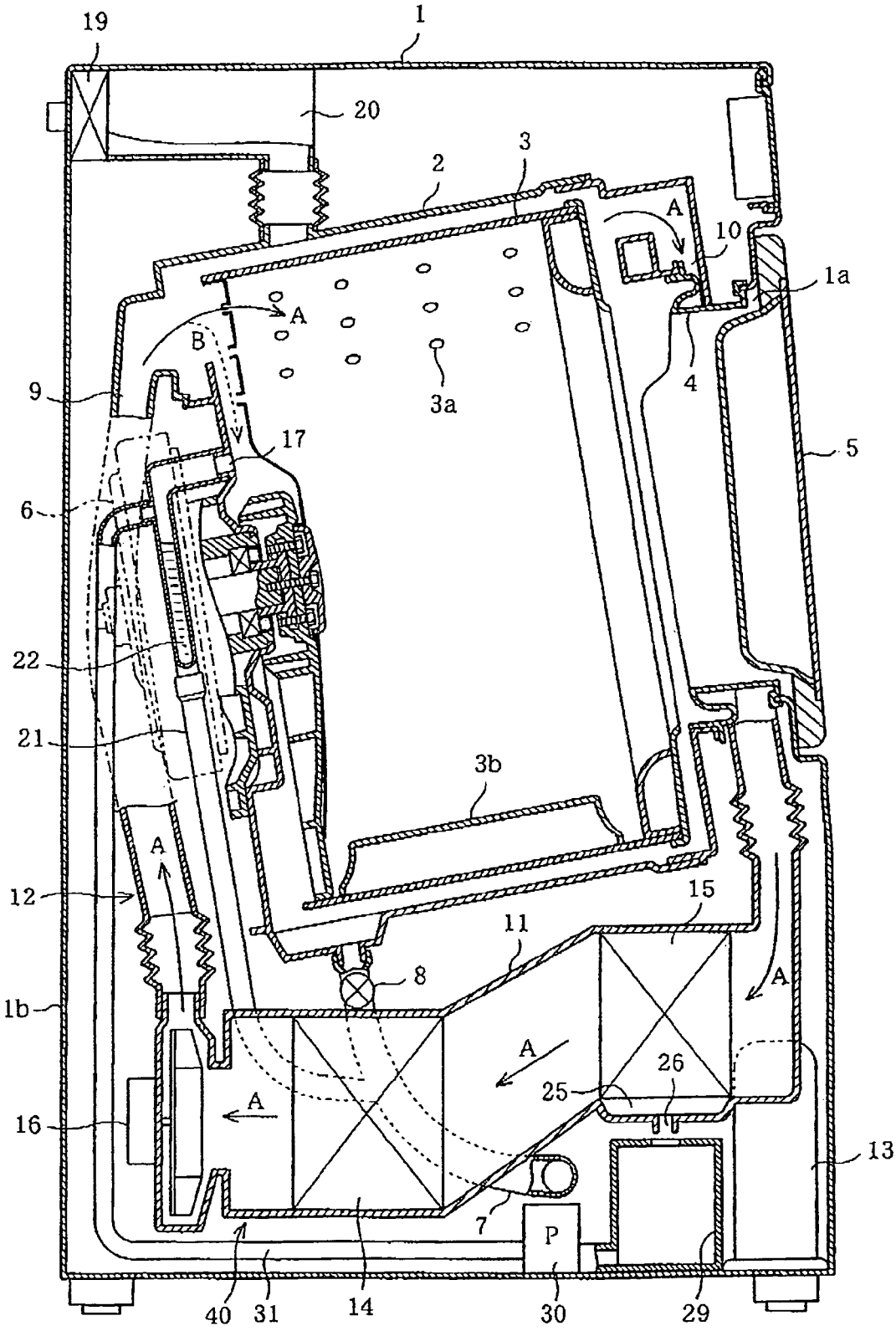
FIG. 4 is a view similar to FIG. 2, showing a second embodiment of the invention.

A second embodiment of the invention will be described with reference to FIG. 4. Identical or similar parts in the second embodiment are labeled by the same reference symbols as those in the first embodiment, and the description of these parts will be eliminated. Only the differences of the second embodiment from the first embodiment will be described.

The second embodiment differs from the first embodiment in the water supplying means for the trap 22 and in the means for treating dehumidification water from the evaporator 15. More specifically, the second embodiment is characterized by the provision of a drain pump 30 as water supplying means fro supplying dehumidification water to the trap 22. Accordingly, tap water from the water supply valve 19 is supplied through the water supply conduit 20 only to the water tub 2.

A dehumidification water tank 29 is installed below the evaporator 15 of the heat pump mechanism 40. The dehumidification water tank 29 stores dehumidification water resulting from cooling and dehumidifying circulated air by the evaporator 15 during the drying step. The dehumidification water tank 29 is located so as to receive the dehumidification water dropping from the drain outlet 26. The dehumidification water tank 29 has a size (volume) set based on an amount of water that results from a dehumidifying operation in a single drying step. For example, in the case where a drying volume is at 6 kg, about 3 liters of dehumidification water are normally produced. In the embodiment, the size of the dehumidification water tank 29 is set so as to have a slight allowance.

The drain pump 30 is provided in association with the dehumidification water tank 29. The drain pump 30 has a pump drain conduit 31 communicating with and connected to the upper water supply inlet 23 of the trap 22 (see FIG. 23) and serves as water supply means for the trap 22. When the dehumidification water has reached a predetermined level in the dehumidification tank 29, the drain pump 30 is driven so that the dehumidification water is discharged through the trap 22 and the overflow conduit 21 outside the machine.

According to the above-described construction, when the dehumidification water produced during the drying step has reached the predetermined level, the drain pump 30 is driven so that the dehumidification water in the dehumidification tank 29 is supplied through the pump drain conduit 31 and the water supply inlet 23 into the trap 22 of the joint member 21*a*. The dehumidification water supplied into the trap 22 overflows the trap, thereby being discharged through the drain passage including the overflow conduit 21 and the drain conduit 7. In this case, when the water level in the dehumidification tank 29 has reduced to the predetermined level, the drain pump 30 is stopped. In response to stop of the draining operation by the drain pump 30, a predetermined amount of water (an amount of water at the water level H as shown in FIG. 3) remains in the U-shaped trap 22, whereupon the trap 22 blocks air flow. The predetermined water level (an amount of water) of the dehumidification tank 29 is set so that at least an amount of water remaining in the trap 22 can be ensured.

After the drying step has progressed for a predetermined time and when the drying step has been completed, the dehumidification water is supplied into and remains in the trap 22 such that the air permeability is cut off between the overflow outlet 17 of the water tub 2 and the exterior of the machine. Even when the drain pump 30 is driven at a plurality of times in the middle of the drying step, the trap 22 is substantially maintained in a water storing state although the water stored in the trap 22 is replaced by newly supplied water. Accordingly, when initially used, the trap 22 stores water in the middle of the drying step and on, thereby blocking air flow. Thereafter, however, water is stored in the trap 22 from the beginning of the drying step. As a result, warm air can be prevented from leaking and an efficient drying can be carried out by circulation warm air.

According to the foregoing embodiment, the evaporator 15 is used as a dehumidifying means so that the dehumidification water is stored. The dehumidification water (drain water) is stored in the trap 22 by the water supply means. Accordingly, the air permeability can be cut off between the overflow outlet 17 of the water tub 2 and the exterior of the machine through the drain passage by using the dehumidification water which is supposed to be discharged. Consequently, waste of tap water can be prevented and aquatic resource can be saved. Furthermore, an operating cost can be reduced and the construction of the washing and drying machine can be prevented from being complicated. Otherwise, as in the first embodiment, a high efficient drying step can be carried out while warm air is prevented from leakage. Still furthermore, the residential environment can be prevented from being adversely affected by the discharged warm air and unpleasantness is not given to the user.

The control of the drain pump 30 is not limited to the control based on the water level but may be modified in various ways. For example, the drive may be controlled based on the time or can be controlled mainly in a time zone in which an amount of dehumidification water is increased (for example, a time zone in which a drying action is so strong that water evaporation is active). Furthermore, although the evaporator 15 of the heat pump mechanism 40 is used as the dehumidifying means, a water-cooled heat exchanger may be used in which air is cooled by an air-cooling means so that water content in the air is condensed thereby to be eliminated. In this construction, however, an electric heater needs to be provided as a warm air generating unit for rendering the dehumidified air warm.

Third Embodiment

A third embodiment of the invention will be described with reference to FIG. 5. The air stopping unit comprises another unit instead of the trap 22 in the third embodiment. The air stopping unit 42 utilizes a spherical float valve 32 as shown in FIG. 5. The overflow conduit 33 comprises the joint member 33*a* provided with the float valve 32 and a hose 33*b*. The joint member 33*a* comprises a float chamber 34 extending upward from the overflow outlet 17 and a conduit 43 extending downward from a side of the float chamber 34. The joint member 33*a* is generally curved into an inverted U-shape. The float chamber 34 and the conduit 43 are formed integrally with each other.

The float chamber 34 comprises a smaller diameter cylindrical portion 34*a* communicating with the overflow outlet 17 and having a smaller diameter than the float valve 32, a circular conical portion 34*b* having an opening diameter gradually increased upward from the smaller diameter cylindrical portion 34*a*, and a larger diameter cylindrical portion 34*c*. The circular conical portion 34*b* includes a lower region serving as a valve seat to which the float valve 32 closely adheres. The float valve 32 has a function of opening and closing a flow path of the overflow conduit 33. The larger diameter cylindrical portion 34*c* of the float chamber 34 has an opening 36 in which a spherically protruding mesh member 35 is mounted. The float chamber 34 communicates via the opening 36 with the hose 33*b*.

Figure 5B:
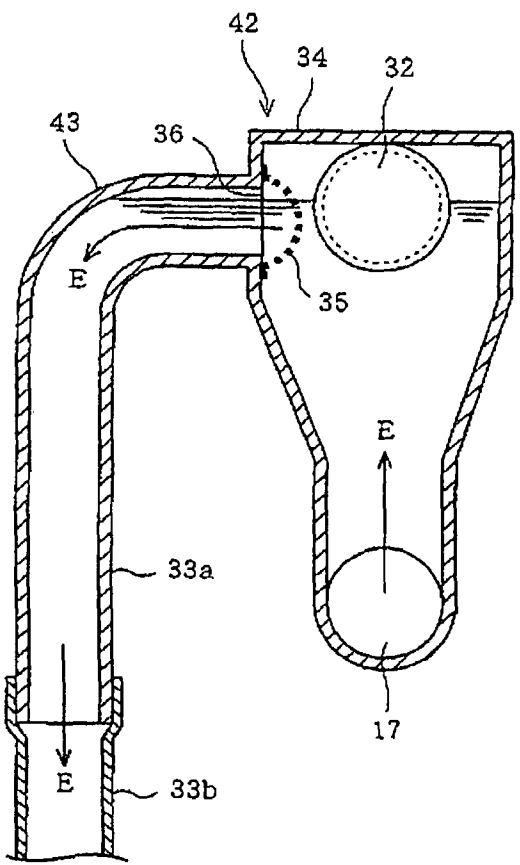
FIGS. 5A and 5B are similar to FIG. 3, showing a closed state and an open state in a third embodiment of the invention respectively.
Figure 5A:
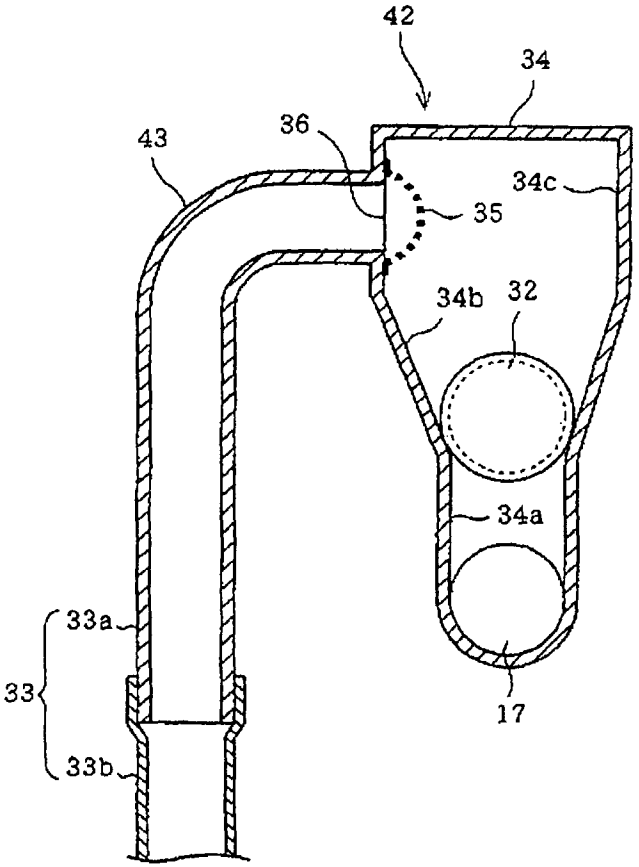

The float valve 32 has a smaller mean density than water and a weight (gravity of the float valve 32) larger than pressure of warm air (an inner pressure of the water tub 2). Accordingly, in a normal state or when no abnormal overflow has occurred, the gravity causes the float valve 32 to adhere closely to the circular conical portion 34*b*, whereby the float valve 32 keeps the flow path of the overflow conduit 33 closed, as shown in FIG. 5A. On the other hand, when water flows through the overflow outlet 17 into the float chamber 34, the float valve 32 comes up and departs from the circular conical portion 34*b*, thereby opening the flow path of the overflow conduit 33, as shown in FIG. 5B. In this case, since the opening 36 is covered with the spherically protruding mesh member 35, the ascended float valve 32 is prevented from being directly fitted in or adhering closely to the opening 36, whereupon the flow path of the overflow conduit 33 is not closed. Accordingly, water flowing from the overflow; outlet 17 into the float chamber 34 smoothly flows in the direction of arrow E in FIG. 5.

As described above, the float valve 32 counteracts against the pressure of warm air received from the water tub 2 side by the gravity thereof, thereby closing the flow path of the overflow conduit 33. On the other hand, when the water supply is in an abnormal condition (an abnormal overflow has occurred), the inflowed water causes the float valve 32 to come up. The float; valve 32 departs from the circular conical portion 34*b*, thereby opening the flow path of the overflow conduit 33. Accordingly, leakage of warm air during the drying step can reliably be prevented as in each foregoing embodiment. Furthermore, when the water level in the water tub 2 is at or above the predetermined level during water supply, the water can be discharged through the overflow outlet 17. Thus, an occurrence of abnormal overflow condition can be prevented. The float valve 32 may only be constructed to come up until the water level in the float chamber 34 reaches the opening 36.

Furthermore, the air stopping unit 42 can be provided which has a simple construction using the float valve 32. Still furthermore, since no water supplying means used in each foregoing embodiment is necessary, water can be saved and no troublesome water supply control is necessitated.

In the construction of the embodiment, drainage from the overflow conduit 33 is allowed when the water level in the water tub 2 reaches the opening 36 located higher than the overflow outlet 17. Accordingly, the overflow outlet 17 needs to be located slightly lower than in each foregoing embodiment. Furthermore, the mesh member 35 attached to the opening 36 may or may not be provided. Any construction may be provided which prevents the float valve 32 from being fitted in or adhering to the opening 36 so that water can normally flow. For example, the spherical float valve 32 can be prevented from being fitted in or adhering to the opening 36 when a circular end of the opening 36 is rendered saw-toothed. Additionally, the float valve 32 should not be limited to the spherical shape and may be practiced in various modified forms.

Fourth Embodiment

A fourth embodiment of the invention will be described with reference to FIG. 6. The air stopping unit 42 comprises the float valve 32 opening the flow path continuous to the drain passage utilizing buoyancy in the third embodiment. In the fourth embodiment, the air stopping unit 44 comprises a valving element 37 opening the flow path continuous to the drain passage utilizing water pressure.

The overflow conduit 38 comprises a joint member 38*a* and a hose 38*b*. The joint member 38*a* comprises a case 39 extending vertically upward from the overflow outlet 17 and a conduit 45 extending downward from a side of the case 39. The joint member 38*a* is totally formed into an inverted U-shape. The case 39 comprises a smaller diameter cylinder 39*a*, a stepped portion 39*b* and a larger diameter cylinder 39*c*.

A valving element 37 which is elastically deformable is provided in the case 39. The valving element 37 has one end side fixed to an inner wall of the case 39 and the other end side which can come into contact with and separate from the stepped portion 39*b*. When being in contact with the stepped portion 39*b*, the other end side of the valving element 37 adheres closely to the stepped portion 39*b*. More specifically, the stepped portion 39*b* has a function of a valve seat of the valving element 37, and the valving element 37 has a function of opening and closing the flow path of the overflow conduit 38.

Figure 6B:
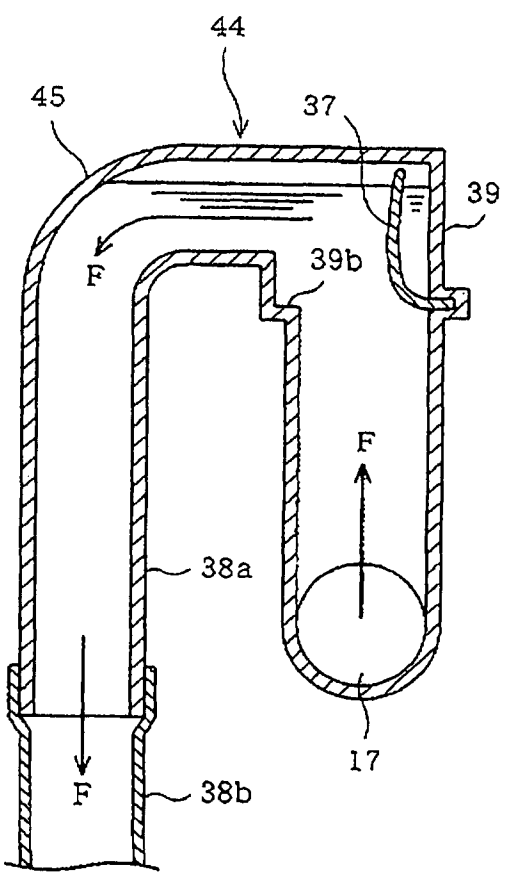
FIGS. 6A and 6B are similar to FIG. 3, showing a closed state and an open state in a fourth embodiment of the invention respectively.
Figure 6A:
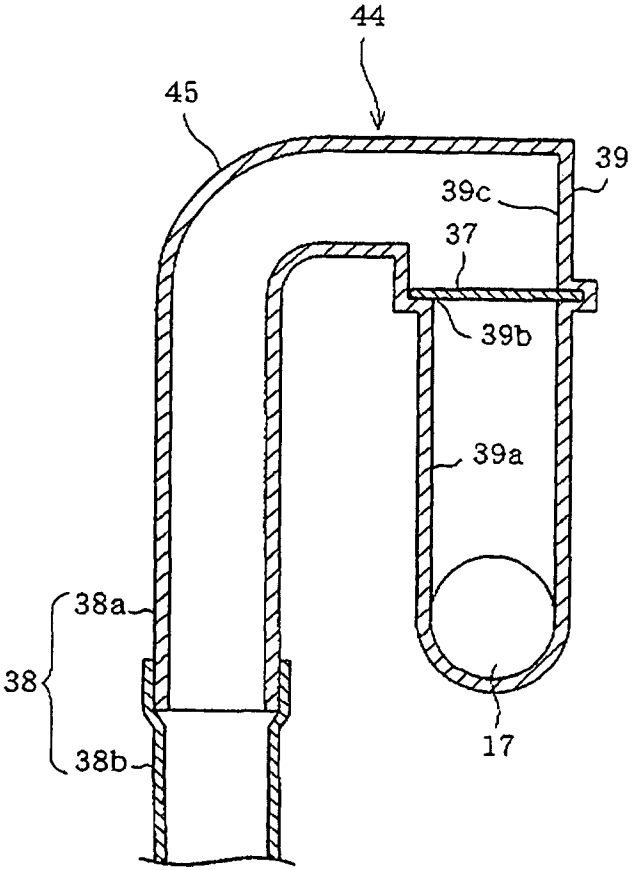

When adhering closely to the stepped portion 39*b*, the valving element 37 remains adherent to the stepped portion 39*b* by the gravity and an elastic force of the valving element 37 even if the valving element 37 is biased in an opening direction (upward in FIG. 6) by the pressure of the warm air from inside the water tub 2, as shown in FIG. 6A. Accordingly, the flow path of the overflow conduit 38 is normally maintained in the closed state by the valving element 37. On the other hand, when water inflows from the overflow outlet 17 (an abnormal overflow has occurred), the valving element 37 is subjected to the water pressure of the overflow water flowing in the joint member 38*a*, whereupon the valving element 37 is kept separated from the stepped portion 39*b*, as shown in FIG. 6*b*. Accordingly, the flow path of the overflow conduit 38 is opened such that drainage in the direction of arrow F in FIG. 6 is continued.

According to the embodiment, leakage of warm air and abnormal overflow water can be avoided as in the foregoing third embodiment. Furthermore, no water supply means and other control means (for example, a mechanism for opening and closing the valving element 37, a sensor for detecting abnormal overflow water) are necessitated and accordingly, a simple construction can be provided.

Other Embodiments

The invention should not be limited to the foregoing embodiments. The embodiments may be modified or expanded as follows. The invention should not be limited to the drum washing and drying machine but may be applied to a washing and drying machine provided with a rotating tub rotatable about a vertical axis. Furthermore, the warm air generating unit should not be limited to the heat pump mechanism 40 but may be constituted by a combination of an electric heater and a blower. The overflow conduit 21, 33 or 38 should not be limited to the combination of the joint member 21*a*, 33*a* or 38*a* and the hose 21*b*, 33*b* or 38*b*. These members may be formed integrally with each other. Furthermore, the position of the air stopping unit 41 or 42 may be changed in the drain passage under the condition that the overflow outlet 17 is provided at a predetermined location.

As described above, the washing and drying machine of the invention is useful as a washing and drying machine which can carry out an efficient drying by preventing leakage of warm air during a drying step without damaging a primary function of an overflow outlet.

The invention claimed is:

1. A washing and drying machine comprising:

a rotating tub having small holes in a circumferential wall and receiving laundry;

a water tub which is provided around the rotating tub and is capable of storing water;

a circulating passage communicating between an interior and an exterior of the water tub so that air is circulated therethrough;

a warm air generating unit rendering air in the circulating passage warm;

an overflow outlet which is provided in a surface of the water tub where warm air is supplied, so that water flows through the overflow outlet when a water level in the water tub is increased to or above a predetermined level;

a drain conduit provided at a bottom of the water tub and extending outside the machine via a drain valve provided midway in the drain conduit, through which water in the water tub is discharged out of the water tub;

an overflow conduit having a lower end connected to a downstream side of the drain valve in the drain conduit and communicating with the overflow outlet and with the outside of the machine;

a trap provided in the overflow conduit and cutting off an air flow by storing water therein, thereby allowing water to pass therethrough and stopping an air flow, wherein the overflow conduit is introduced outside the machine via the trap;

a water supply unit separate from the overflow outlet and coupled to the trap to introduce water to the trap other than from the drain conduit; and a dehumidifying unit provided in the air circulation passage to cool the circulated air so that a water content of the circulated air is condensed, wherein the water supply unit supplies dehumidification water discharged by the dehumidifying unit to the trap.

2. The washing and drying machine of claim 1, wherein the overflow conduit comprises a joint member that includes the trap, and an upper end of the joint member is connected to the overflow outlet.

3. The washing and drying machine of claim 1, wherein the water supply unit is a conduit branching off from a water supply conduit that supplies water into the water tub.

4. A washing and drying machine comprising:

a rotating tub having small holes in a circumferential wall and receiving laundry;

a water tub which is provided around the rotating tub and is capable of storing water;

a circulating passage communicating between an interior and an exterior of the water tub so that air is circulated therethrough;

a warm air generating unit rendering air in the circulating passage warm;

an overflow outlet which is provided in a surface of the water tub, so that water flows through the overflow outlet when a water level in the water tub is increased to or above a predetermined level;

a drain conduit provided on a bottom of the water tub and introduced outside the machine via a drain valve, through which water in the water tub is discharged out of the water tub;

an overflow conduit having a lower end connected to a downstream side of the drain valve in the drain conduit and communicating with the overflow outlet and with the outside of the machine;

an air stopping unit provided in the overflow conduit and including a trap cutting off an air flow by storing water therein and a water supply unit supplying water to the trap, thereby allowing water to pass therethrough and stopping an air flow, wherein the overflow conduit is introduced outside the machine via the air stopping unit; and a dehumidifying unit provided in the air circulation passage to cool the circulated air so that a water content of the circulated air is condensed, wherein the trap water supply unit supplies dehumidification water discharged by the dehumidifying unit to the trap.

5. A washing and drying machine comprising:

a rotating tub having small holes in a circumferential wall and receiving laundry;

a water tub which is provided around the rotating tub and is capable of storing water;

a circulating passage communicating between an interior and an exterior of the water tub so that air is circulated therethrough;

a warm air generating unit rendering air in the circulating passage warm;

an overflow outlet which is provided in a surface of the water tub lower than an outlet of the circulating passage, so that water flows through the overflow outlet when a water level in the water tub is increased to or above a predetermined level;

a drain conduit provided on a bottom of the water tub and including a drain valve, through which water in the water tub is discharged out of the water tub;

an overflow conduit comprising a joint member and having a lower end connected to the drain conduit downstream of the drain valve, the joint member including an upper end connected to the overflow outlet and a trap that stores water and cuts off air flow out of the machine, the trap including a U-shape and a water supply inlet formed in an upper part of the trap; and a trap water supply unit coupled to the water supply inlet that supplies water to the trap.

6. The washing and drying machine of claim 5, wherein the trap water supply unit is separate from the overflow outlet.

* * * * *